US005373936A

United States Patent [19]

Kawai et al.

[11] Patent Number: 5,373,936

[45] Date of Patent: Dec. 20, 1994

[54] STORAGE CONTAINER

[75] Inventors: Tsutomu Kawai; Akira Miyakawa; Hideki Yamaguchi, all of Yokohama; Hitoshi Nakamura, Kawasaki; Hisashi Morioka, Kawagoe, all of Japan

[73] Assignee: Canon Kabushiki Kaisha, Tokyo, Japan

[21] Appl. No.: 25,760

[22] Filed: Mar. 3, 1993

[30] Foreign Application Priority Data

Mar. 9, 1992 [JP] Japan ..... 4-050636

[51] Int. Cl.[5] ..... B65D 81/26

[52] U.S. Cl. ..... 206/204; 206/576; 206/334; 346/146; 347/86

[58] Field of Search ..... 346/140 R, 146; 206/204, 216, 576, 328, 334, 371, 384, 385, 817

[56] References Cited

U.S. PATENT DOCUMENTS

| | | | |
|---|---|---|---|
| 1,106,144 | 8/1914 | Harrison | 206/204 X |
| 4,600,927 | 7/1986 | Sugitani . | |
| 5,029,699 | 7/1991 | Insley et al. | 206/204 |
| 5,231,416 | 7/1993 | Teresawa et al. | 346/146 X |
| 5,231,425 | 7/1993 | Masuda et al. | 346/146 X |
| 5,244,087 | 9/1993 | Hikake et al. | 206/471 X |
| 5,244,092 | 9/1993 | Karita et al. | 206/462 |

FOREIGN PATENT DOCUMENTS

| | | |
|---|---|---|
| 0320165 | 6/1989 | European Pat. Off. . |
| 0391686 | 10/1990 | European Pat. Off. . |
| 0439728 | 8/1991 | European Pat. Off. . |
| 61-093265 | 6/1986 | Japan . |
| 2-24149 | 1/1990 | Japan . |
| 2-34353 | 2/1990 | Japan . |
| 03101944 | 4/1991 | Japan . |
| 03101945 | 4/1991 | Japan . |
| 03176156 | 7/1991 | Japan . |
| 03234659 | 10/1991 | Japan . |
| 4-62158 | 6/1992 | Japan . |

OTHER PUBLICATIONS

Eur. Pat. Off. Search Report For Eur. Pat. Appln. No. 93103700.6.

*Primary Examiner*—Paul T. Sewell
*Assistant Examiner*—Jacob K. Ackun, Jr.
*Attorney, Agent, or Firm*—Fitzpatrick, Cella, Harper & Scinto

[57] ABSTRACT

A storage container for housing and storing an ink jet cartridge which has a recording head to discharge ink, and an ink tank to contain ink to be supplied to the recording head and which is structured to be exchangeable with respect to a recording apparatus comprises a capping member to be in contact with the ink discharge port surface of the recording head to cover the surface thereof and absorbing members conductively connected to the capping member to absorb ink which leaks from the recording head. With the capping member and absorbing member, an airtightness higher than that of the discharge ports is obtained in order to suppress the ink evaporation from the discharge ports of the recording head while the cartridge which is still in use is kept in the storage container.

9 Claims, 5 Drawing Sheets

STORAGE CONTAINER

BACKGROUND OF THE INVENTION

1. Field of the Invention

The present invention relates to a storage container for housing and storing an ink jet cartridge when it is not in use. Such a cartridge is attachable to or detachable from a recording apparatus which performs a desired recording by discharging ink from a discharge port.

2. Related Background Art

For an ink jet recording apparatus which performs a desired recording by discharging ink from its recording head, various embodiments are known wherein a recording head and an ink tank containing ink to be discharged from the recording head are provided separately to replace the currently-used ink tanks when the ink therein is exhausted, and a cartridge type comprising a recording head and an ink tank integrally, which is structured to be replaceable with respect to an apparatus.

The recording head of a cartridge form is housed for storage in such a manner that a seal is placed on the discharge port portion of the recording head and further, the seal for the discharge port portion is covered and secured thereto by a cap, such as the so-called blister pack housing container, when the cartridge is distributed as disclosed in Japanese Patent Application Laid-Open No. 3-101944, Japanese Patent Application Laid-Open No. 3-101945, Japanese Patent Application Laid-Open No. 3-176156, and Japanese Patent Application Laid-Open No. 3-234659, for example.

Now, if for some reason the ink jet cartridge should be stored temporarily while it is still in use for recording, it is difficult to utilize the above-mentioned storage container for preserving the cartridge for further use. In other words, although it is possible to attach a cap to the cartridge after it has been opened once for use, and store it in the container, it is impossible to obtain an airtight seal of the discharge ports; thus it is not possible to fully suppress the evaporation of ink from the discharge port portion, leading to a possibility that the discharge ports become clogged among other adverse effects.

On the other hand, there are proposed storage container structures for storing a cartridge of the kind such as disclosed in Japanese Patent Application Laid-Open No. 61-93265, and others. The proposed structures are such that a cover is provided to make the inner space of the container substantially airtight while material of extremely low permeability is used to form the container in order to suppress the evaporation of ink.

Nevertheless, there is still a possibility that ink is evaporated until the component in the inner airtight space becomes the same as the component of the ink, that is, until an equilibrium state is reached, or a possibility that the ink begins leaking from the discharge ports due to changes in surrounding environment. It is also difficult to secure sufficient airtightness; hence causing the discharge ports may still become clogged in some cases. The reliability of this scheme is not good enough.

SUMMARY OF THE INVENTION

It is an object of the present invention to solve the foregoing technical problems and provide a storage container capable of performing a highly reliable storage of an ink jet cartridge which is still in use.

The inventors have learned after assiduous discussions and experiments that to achieve the aforesaid object that at least a cap and absorbing member should be provided for a storage container to secure an airtightness in it which is higher than that of the discharge ports in order to suppress the ink evaporation, while at the same time retaining in the absorbing member any ink that may leak due to changes in the surrounding environment; hence maintaining the wetting state in the cap to prevent the discharge ports from being clogged, and attain a highly reliable storage of the cartridge.

Further, it is known that even the clogged discharge ports can be recovered by an ink exhaust operation with the provision of a so-called recovery mechanism wherein a pump is connected to a cap to perform the ink exhaust from the discharge ports. With the knowledge thus acquired, a storage container having a higher reliability can be provided.

The present invention is designed on the basis of this knowledge and experiments, and there are provided the following for a storage container to house and store an ink jet cartridge which is replaceable with respect to a recording apparatus, which comprises a recording head to discharge ink, and an ink tank to contain ink to be supplied to the aforesaid recording head according to the present invention:

a capping member to cover the ink discharge port surface by contact with the ink discharge port surface of the aforesaid recording head portion; and an absorbing member conductively connected to the aforesaid capping member to absorb any ink leaking from the aforesaid discharge port surface.

Further, the storage container is provided with pumping means conductively connected to the capping member to generate pressure to cause ink to be exhausted from the aforesaid recording head, and the exhausted ink from the recording head is retained in the aforesaid absorbing member.

Since at least a cap and an absorbing member are provided according to the present invention, it is possible to secure an airtightness higher than that of the discharge ports and suppress the ink evaporation from the discharge ports. Also, with the absorbing member, it is possible to retain any ink that may leak due to changes in the surrounding environment. In this way, a wetting state is maintained in the space formed by the discharge-port formation surface and the capping member thereby making it unlikely that any resultant clogging of the discharge ports will occur. Also, with the provision of a recovery mechanism, it is possible to remove such clogging particles by causing ink to be exhausted from the discharge ports if there should be any discharge port which has been clogged.

DETAILED DESCRIPTION OF THE PREFERRED EMBODIMENTS

Hereinafter, with reference to the accompanying drawings, the description will be made in detail of the specific embodiments according to the present invention.

Figure 4:
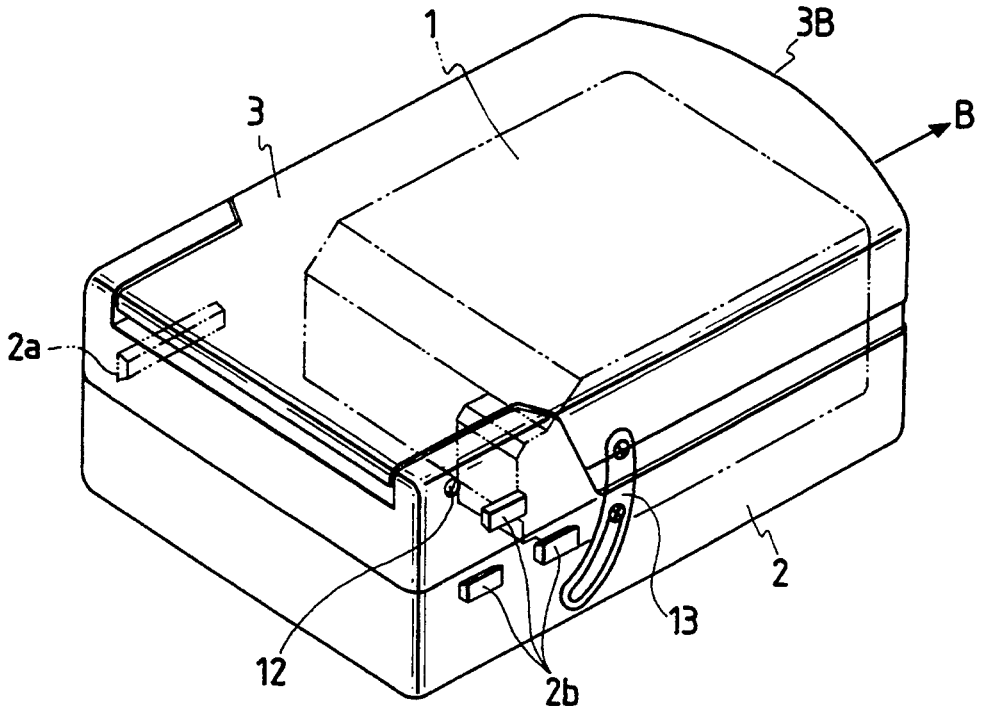
FIG. 4 is a perspective view schematically illustrating the outer appearance of a storage container according to an embodiment of the present invention.

FIG. 4 is a perspective view schematically illustrating the outer appearance of a storage container according to an embodiment of the present invention. Also, FIG. 1 is a cross sectional view schematically showing the structure of storage container according to an embodiment of the present invention.

As shown in FIG. 4, a storage container comprises a storing unit in which an ink cartridge 1 is arranged for storage; a lower housing 2 having an opening through which the ink cartridge is stored or withdrawn; and an upper housing 3 which serves as a covering member to cover the opening and to open or close it when the ink cartridge is stored or withdrawn. The upper housing 3 is arranged to pivot on a hinge pin 12 with respect to the lower housing 2 for the storage and withdrawal of the ink cartridge. 1.

Figure 1:
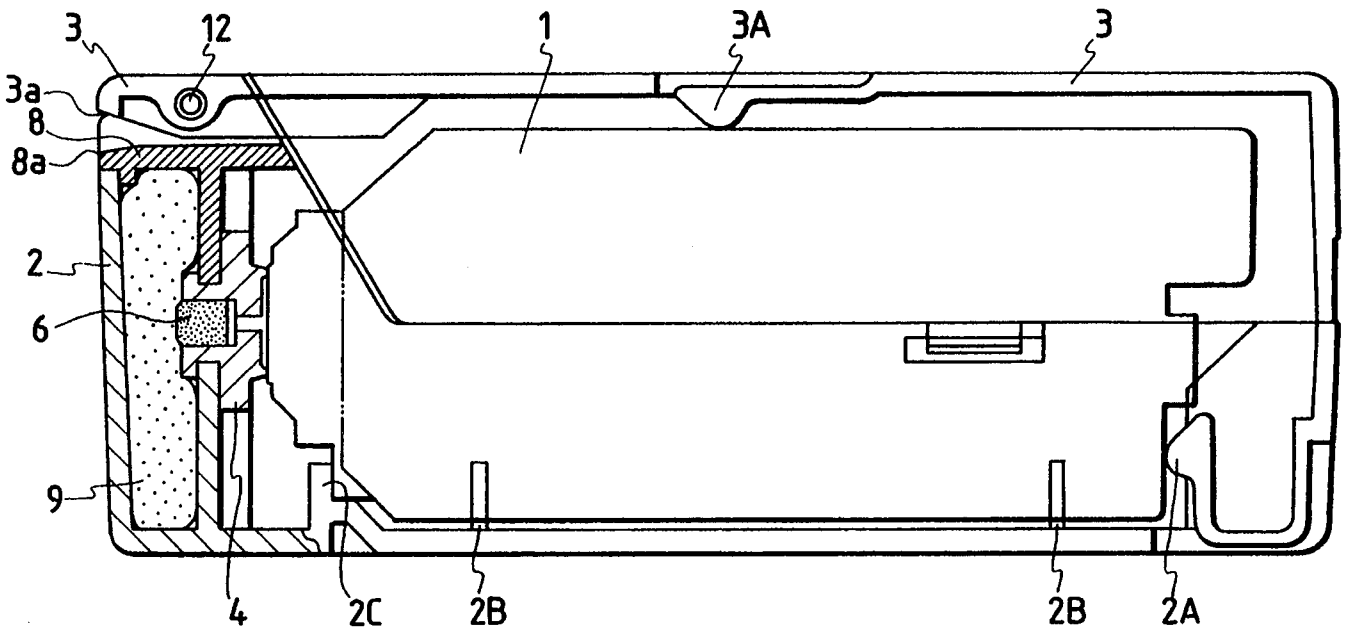
FIG. 1 is a cross sectional view schematically showing the structure of a storage container provided with a cap and an absorbing member according to the present invention.

Further as shown in FIG. 1, the storage container is arranged so that the cap 4 which covers the ink discharge port surface is positioned to face the ink jet cartridge 1 when it is installed at one end side of the lower housing 2 of the container. Thus, it is possible to suppress unwanted ink evaporation from the discharge ports by creating an airtight space with the cap 4 which covers the ink discharge port surface. In this respect, the ink jet cartridge is pressed by a spring member 2A which will be described later from its rear side in order to cause the ink discharge port surface to be pressed against the cap 4 creating a highly airtight space between the ink discharge port surface and the cap 4. Furthermore, it is preferable to form the cap 4 from a resilient material such as rubber to make the airtightness even greater.

Also, behind the cap 4, a first absorbing member 6 and a second absorbing member 9 are provided. These absorbing members 6 and 9 are arranged to absorb any ink which leaks due to changes in the surrounding environment from the ink discharge ports tightly closed by the cap 4. Particularly, the first absorbing member 6 has a capability to keep the airtight space in a wetting state because of the leaking ink and is able to prevent the ink discharge ports from becoming clogged.

As described earlier, in the lower housing 2 of the storage container, a spring member 2A is provided to press the cap 4 against the discharge port surface of the ink jet cartridge 1. This spring member 2A is a flat spring integrally formed with the lower housing 2 with an inclined upper surface having a slope toward the bottom of the lower housing 2 in order to facilitate the installation of the ink jet cartridge 1 in the container.

On the other hand, on a part of the upper housing 3 of the storage container, a spring member 3A is integrally formed with the upper housing 3, and when the upper housing 3 is closed, the ink jet cartridge 1 is pressed thereby from the above toward the bottom of the lower housing 2. These spring members 2A and 3A are formed with the respective housings 2 and 3; this reduces the number of parts needed, which decreases costs and simplifies fabrication.

Also, in the lower housing 2, there are provided ribs 2B on the bottom and side face to be in contact with the bottom and side face of the cartridge 1 and also, a rib 2C in the vicinity of the side face where the cap 4 is arranged to be in contact with a part of the front end of the recording head, respectively. These ribs 2B and 2C are arranged to position the ink jet cartridge 1 for storage in the container and make it possible to enhance the precision with which the cartridge 1 is positioned in cooperation with the foregoing spring members 2A and 3A which press the cartridge. Thus, the of the ink discharge ports by the cap 4 are even more reliably protected.

Figure 2:
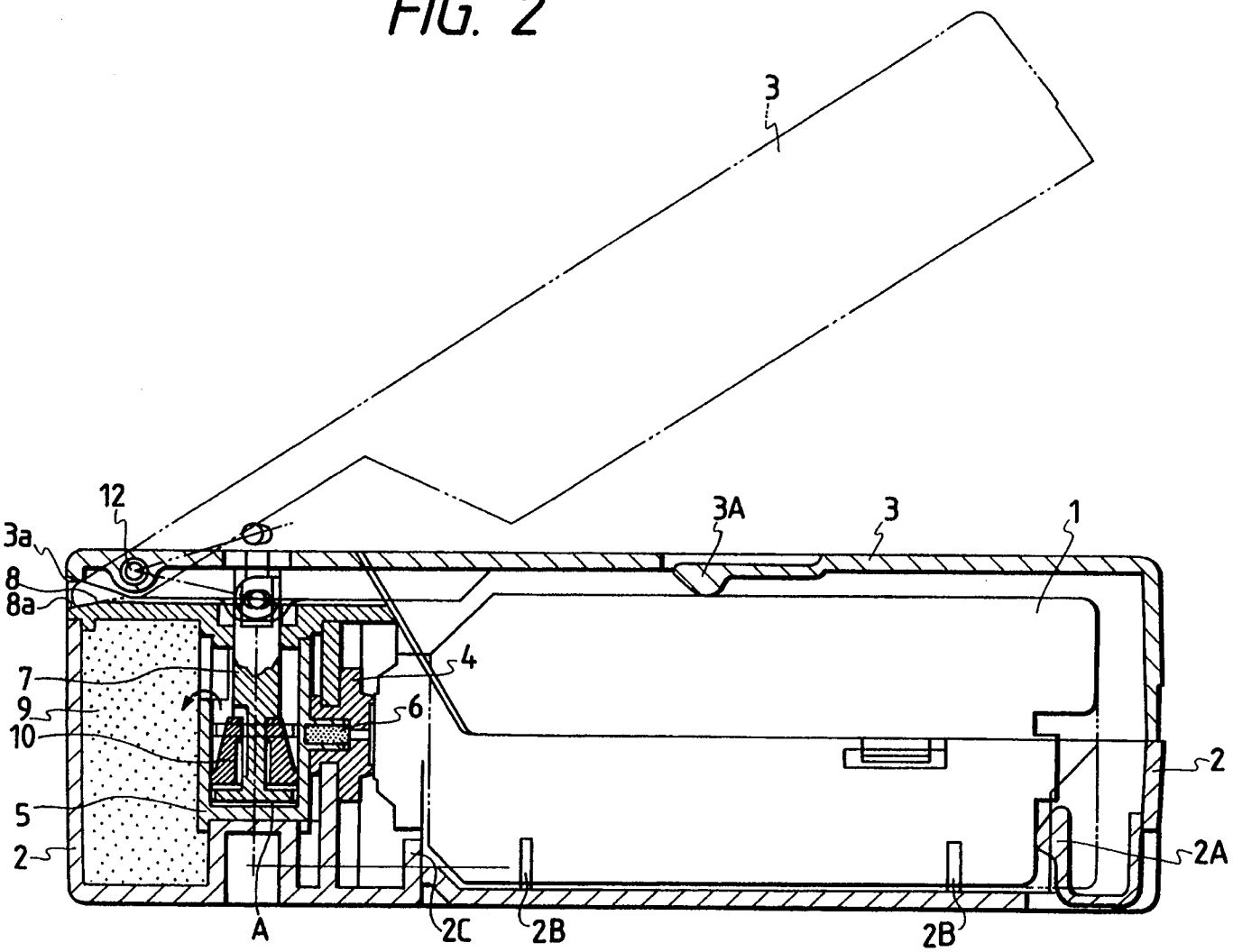
FIG. 2 is a cross sectional view schematically showing the structure of a storage container provided with a cap, an absorbing member, and a pump mechanism according to the present invention.

Now, FIG. 2 illustrates a storage container in which a structure is adopted to remove the clogging particles of the discharge ports by providing a pumping means capable of performing a recovery operation positively in addition to the protection given to the discharge ports by providing the cap 4 and absorbing members 6 and 9 in the storage container as described above.

As clear from FIG. 2, a pumping mechanism is arranged between the cap 4 and the second absorbing member 9 to suck ink from the ink discharge ports in addition to the structure shown in FIG. 1. The pumping mechanism mainly comprises a cylinder 5, a piston 10, and a piston rod 7. The pumping mechanism is conductively connected through the passage provided with the cap 4 and the first absorbing member 6, and further, the ink which is cleared by the pumping mechanism is collected to the second absorbing member 9 which is conductively connected to the pumping mechanism. The piston rod 7 which causes the piston 10 to be vertically moved is coupled to the upper housing 3 constituting the storage container, and an arrangement is made to drive the pump through the opening and closing of the upper housing 3.

The pumping operation is performed as follows. In other words, with the releasing operation of the upper housing 3, the piston 10 disposed at the lower dead point in the cylinder 5 is shifted upward by the piston rod 7 (the upper face of the piston rod 7 being close contact with the bottom end of the piston 10), and the pump chamber A formed between the cylinder 5 and the piston rod 7 is expanded with its pressure being reduced. When the piston 10 is positioned at the upper dead point after passing the passage provided with the first absorbing member which conductively connects the pumping mechanism and the cap 4, the ink discharge port portion of the ink jet cartridge is in a state of a reduced pressure so that ink is forcibly cleared from the discharge ports by suction. Then, the cleared ink flows into the pumping chamber A passing through the passage. Subsequently, the piston 10 at the upper dead point is shifted downward by the closing operation of the upper housing 3 to the upper face of the piston rod 7 and the bottom end of the piston 10 which have been in a close contact are now separated. Thus, the ink in the pumping chamber A flows into the upper portion of the piston 10 through a groove formed in the piston rod 7. The ink is absorbed and retained in the second absorbing member 9 which is conductively connected to the pumping mechanism along an-arrow mark in FIG. 2.

In this respect, the first absorbing member 6 arranged in the connecting passage between the cap 4 and the pumping mechanism serves to prevent the cleared ink from being returned again by the shift of the piston 10 into the cap 4 which is closely in contact with the discharge ports.

Figure 3:
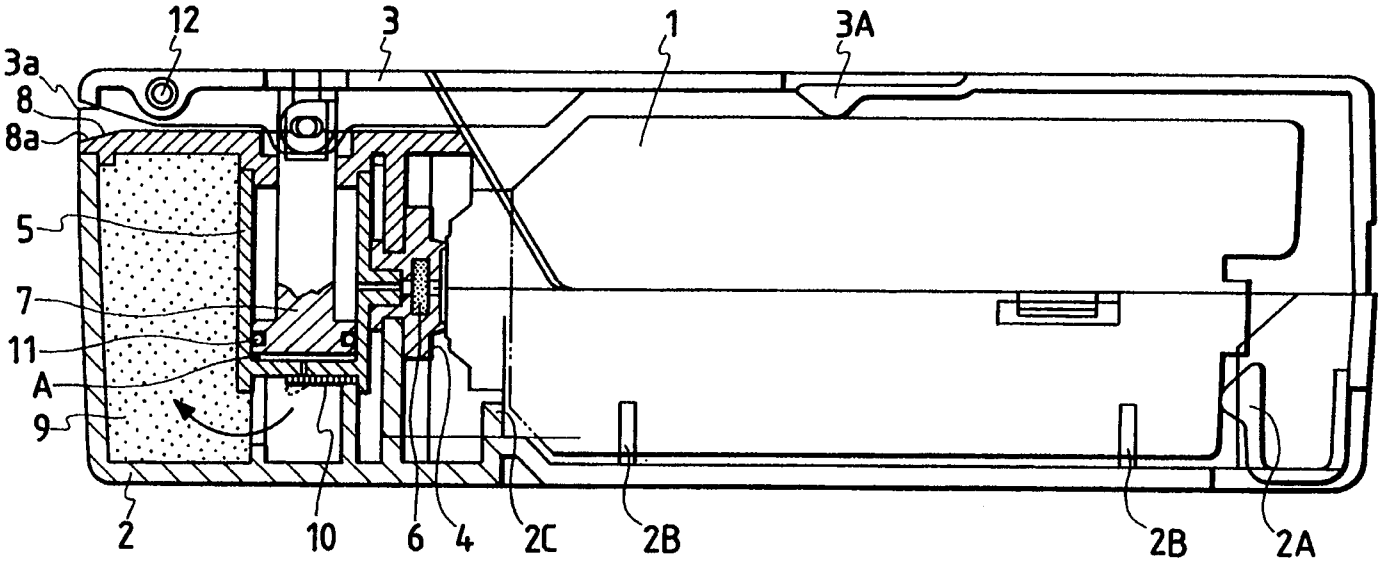
FIG. 3 is a cross sectional view schematically showing the outer appearance of a storage container according to an embodiment of the present invention.

FIG. 3 is a view schematically showing a storage container in which another structural example of the pumping mechanism is installed. This pumping mechanism is such that an opening is provided at the bottom of a cylinder 5 with a check valve 10 which closes or opens the aforesaid opening in synchronism with shifting of a piston rod 7. An O ring is provided for the piston rod 7 to maintain the airtightness of the cylinder 5. The foregoing check valve 10 is made from rubber or some other suitable material. The structure of the pumping mechanism shown in FIG. 3 enables the piston rod 7 positioned at the lower dead point in the cylinder 5 fixed to an upper housing 3 to be shifted upward by the releasing operation of the upper housing 3. Thus, the check valve 10 at the bottom of the cylinder 5 closes the cylinder opening, and a pumping chamber A formed between the bottom end of the piston rod 7 and the cylinder 5 is expanded with its pressure being reduced. When the piston rod 7 is positioned at the upper dead point after passing the passage where a first absorbing member conductively connected to the cap 4 is provided, the ink discharge port portion of the ink jet cartridge is in a state of the reduced pressure so that ink is forcibly cleared from the discharge port by suction. Then, the cleared ink is caused to flow into the pumping chamber A through the 10 passage. Subsequently, when the piston rod 7 at the upper dead point is shifted downward by the closing operation of the upper housing 3, the check valve 10 which has been closely in contact with the bottom opening of the cylinder 5 is separated from the bottom face of the cylinder 5. The ink in the pumping chamber allows therefrom to be absorbed and retained by the second absorbing member 9 which is conductively connected to the pumping mechanism along an arrow mark in FIG. 3.

The aforesaid second absorbing member 9 has sufficient capacity to absorb the total quantity of ink contained in the ink jet cartridge. The present embodiment includes an absorbing member 9 capable of collecting ink of approximately 25 cc. This is a resultant volume worked out by a calculation with an effective efficiency of 70% in order to prevent any leakage of the absorbed ink due to changes in the surrounding environment. The maximum storable quantity of the exhausted ink by the absorbing member 9 is approximately 35 cc.

Now, for the structure in which the piston rod 7 fixed to the upper housing 3 is operated by the utilization of the opening and closing operation of the upper housing 3 as in the above-mentioned pumping mechanism of the storage container, it is necessary to regulate the range within which the upper housing 3 should be opened or closed. In other words, without any means to regulate such a range, the releasing state of the upper housing 3 is assumed to be regulated by the stroke of the pump at the upper dead point. In this case, the load applied to the pump becomes too great, and if any great force is exerted unnecessarily on the upper housing 3, there is a possibility that the pumping mechanism is destroyed.

Therefore, according to the present embodiment, a regulating member 13 is provided between the upper housing 3 and the lower housing 2 of the storage container as shown in FIG. 4. This regulating member 13 comprises a board provided with an opening configured along the locus of the open and close operation of the upper housing 3, and a pin provided on the lower housing 2 side which engages with this opening. Then, the board member is fixed to the upper housing 3 at one end with the opening being arranged to engage with the pin. The releasing position of the upper housing 3 is regulated by the engagement between the one end of the pin and the opening of the board member so as to restrict any further releasing operation. With this positional regulation implemented by the dedicated regulating member 13 for the upper housing 3, it is possible to protect the pumping mechanism from any damage even when more power is used to released the upper housing 3 than is required. It is also possible to drive the pumping mechanism reliably. Here, it is preferable to use a metal or the like as a material to form the board member because of the strength needed.

In this respect, the structure of the regulating member 13 is not necessarily confined to the one shown in FIG. 4. For example, it may be possible to adopt a structure thereby to arrange a slope 3*a* as shown in FIG. 2 on the leading end side of the hinge 12 serving as the center of the opening and closing operation of the upper housing 3 which is fixed thereto, and then, to regulate the releasing angle of the upper housing 3 in cooperation with the wall face 8*a* of the lower housing 2 side which is in the position opposite to the slope thus arranged. Nevertheless, from the viewpoint of reliability, it is more preferable to provide the regulating member 13.

Now, the ink jet cartridge to be stored in the storage container requires care be given to its storing mode because it contains liquid ink therein. In other words, if the recording head portion of the cartridge is stored upright in relation to the gravity, there is a possibility that ink returns from the recording head portion to the tank side. If ink is thus removed from the recording head portion, the recovery operation should be repeated more than is normally done when the cartridge is used for the next recording; hence making it difficult to maintain the reliability in storage.

Therefore, according to the present embodiment, the cartridge receiving side of the storage container is curved in its configuration as at 3B in order to make it difficult to hold the recording head portion upward in relation to the gravity. In this way, it is possible to avoid the foregoing problem simply because the recording head portion cannot store upright in the container. This means that it will suffice if only the storage container is laid down with its side end facing downward by providing a slope or the like on the side face of the container opposite to the position where the recording head should not be placed when stored.

The aforesaid storage container can be preferably used as a provisional storage container for an ink cartridge still in use when another ink jet cartridge should be used among some other cases.

A recording mode of the kind can be preferably utilized for performing color recording with an apparatus provided with one carriage on which one ink jet cartridge is mountable, for example. In other words, if an image should desirably be formed emphatically in red ink by the use of an apparatus wherein recordings are performed by an ink cartridge which usually contains black ink, the objective recording should be executed by exchanging a red ink cartridge and a black ink cartridge as required. Then, after the termination of such recording, the red ink cartridge which is still usable can be stored in the foregoing storage container in a highly reliable condition.

Figure 5:
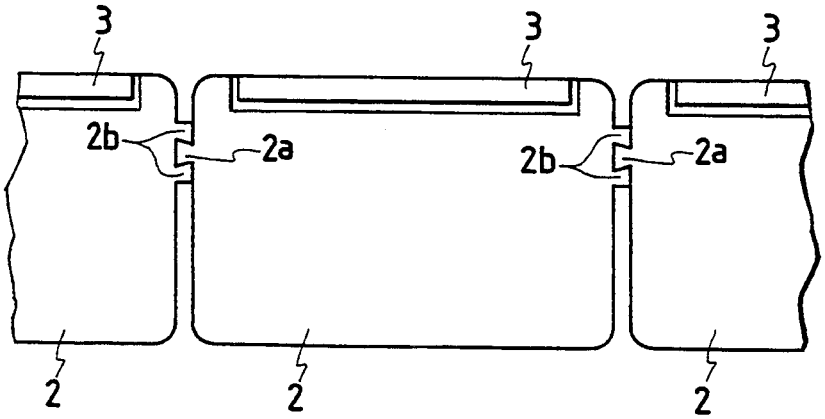
FIG. 5 is a schematic view partially showing one structural example of the coupling state of a storage container according to the present invention.

Also, if recording should be performed by exchanging different ink cartridges with each other, a number of storage containers matching the number of cartridges required when such a recording is terminated, the black ink cartridge remains to be installed on the apparatus in most cases. Then, at least a corresponding number of storage containers for the remaining color ink cartridges are needed). When a plurality of storage containers are required in a case such as this, it is preferable to provide the storage containers for each color together rather than individually. Here, as shown in FIG. 4, a rail member 2*a* and a rail member receptacle 2*b* are arranged on the side faces of the storage container, and by connecting them, plural storage containers can be joined. According to the present embodiment, the rail member 2*a* and rail member receptacle 2*b* are of the so-called slit tail configuration to fit together other as shown in FIG. 5, and are arranged to slidably engage with each other.

Figure 6:
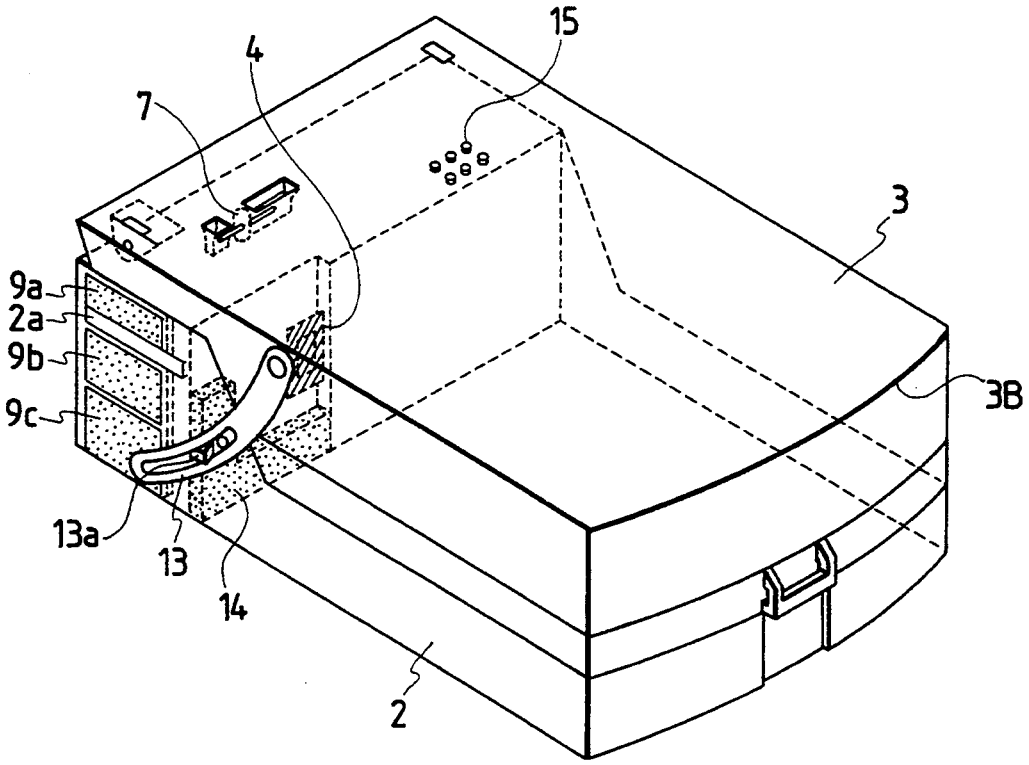
FIG. 6 is a view schematically showing another embodiment of the storage container according to the present invention.

Furthermore, FIG. 6 is a view schematically showing a storage container which is provided with a stopper as a regulating member 13. A storage container of the type where a suction recovery mechanism is provided for an ink jet cartridge is arranged to perform its recovery operation by the opening and closing operation of the upper housing. Ordinarily, any unnecessary opening and closing operation of the upper housing leads to the wasteful consumption of ink. To counteract this, a stopper 13*a* is provided as the regulating member 13 as shown in FIG. 6 so that the upper housing can be fixed at its maximum releasing position. Thus, there is no possibility that the upper housing will be closed by its own weight and the like; making it possible to prevent any unnecessary opening and closing operation when the cartridge is removed. Also, with this arrangement, it becomes easier to remove the cartridge.

Now, the material used for a storage container of the kind should preferably be a material which is sufficiently strong, but easy to machine. Such materials include plastic, ABS and the like. Moreover by using a transparent or semitransparent material for the storage container, it is possible to ascertain whether any cartridge is in the container or not; hence preventing any unnecessary opening and closing of the container. Also, in this way, the ink retained in the second absorbing member 9 is visible. If, therefore, a number of color ink storage containers are employed, it is possible to confirm each individual ink color and prevent any color mixture for the head. Further, the quantity of absorbed ink in the second absorbing member 9 is also recognizable. Hence, the absolute quantity of absorption of the ink absorbing member can be determined. Therefore, if the second absorbing member 9 is arranged To be a three-layer structure as shown at 9*a* to 9*c*, for example, it is possible to ascertain more clearly the absolute quantity of absorption of the ink absorbing member because ink is being absorbed by each absorbing member of the layers in that order.

In this respect, according to FIG. 6, in addition to the first absorbing member and second absorbing members 9*a* to 9*c*, a third absorbing member 14 is provided in the circumference of the cap 4. This third absorbing member is L-shaped, and is installed on the lower left-hand side of the cap 4 in order to prevent the inside of the storage container from being stained if any counterflow of ink should occur by some reason. A reference numeral 15 designates an air conduit opening provided for the purpose of adjusting the pump pressure appropriately.

It is preferable to use the above-described storage container for storing a color ink cartridge which is not frequently used. Accordingly, it is preferable to sell the storage container for the cartridge and color ink cartridge packed together in one package. Then, the cartridge is collected together with the storage container when the ink in the cartridge is totally consumed. It is thus possible to eliminate any possibility of staining the surrounding environment by the leakage of slight amounts of ink remaining in the cartridge in the process of collecting of the used cartridge.

As described above, according to the present invention, there are provided at least a cap and absorbing member to provided airtightness higher than that of the discharge ports; hence making it possible to suppress the ink evaporation from the discharge ports. Also, with the absorbing member, it is possible to retain the ink which leaks due to changes in the surrounding environment and thus, keep the inside of a space formed by the cap and the discharge port formation surface in a condition, thereby eliminating the possibility that the discharge ports are clogged. In addition, with the provision of-a recovery mechanism, it is possible to remove the clogging particles by causing ink to be cleared from the discharge ports even if there some discharge ports are clogged.

It is, therefore, possible to provide a storage 10 container capable of storing with high reliability an ink jet cartridge which is still in use.

What is claimed is:

1. A container for containing an ink jet cartridge exchangeably mountable on an ink jet apparatus having an ink jet head provided with an ink discharge section for discharging an ink and an ink tank for storing the ink to be supplied to said ink jet head, said container comprising:

a lower housing for accommodating said inkier cartridge;

an upper housing for covering said lower housing, said upper housing being reciprocable about a pivot mount in a vicinity of a given side edge thereof between an opened position and a closed position with respect to said lower housing;

a cap section for covering said ink discharge section of said ink jet head;

pressing means for pressing said ink cartridge to securely seal said ink discharge section with said cap section;

pump means for pumping connected to said cap section, said pump means applying a negative pressure to said ink discharge section to clear ink therefrom, said pump means being connected to said upper housing and generating the negative pressure by utilizing reciprocable movement of said upper housing between the opened position and the closed position; and an ink storing section connected to said pump means to store ink cleared by said pump means.

2. A container according to claim 1, wherein said container further comprises elastic keeping means for keeping a containing position of said ink jet cartridge in said lower housing.

3. A storage container according to claim 1, further comprising an absorbing member provided in a part of a connecting passage between said cap and said pump means.

4. A container according to claim 1, wherein an opening angle of said upper housing is determined by a sloped surface extending from said pivot point to the given side edge of said upper housing.

5. A storage container according to claim 1, further comprising an inclined portion which is provided in said container for a part of the housing constituting said container so that at least the ink discharge section of said recording head is not positioned upward in gravitational direction.

6. A storage container according to claim 1 having a plurality of side faces, and further comprising engaging means for engaging another container, said engaging means being disposed on at least one of the side faces of said container.

7. A container according to claim 1, wherein said ink storing section has an absorbing member for absorbing sucked ink.

8. A container according to claim 1, wherein said ink storing section has an atmospheric communicating port for communicating an interior of said ink storing section with the atmospheric air.

9. A container according to claim 1, wherein an opening angle by the opening and closing movement of said upper housing is defined by a moving member provided along with said upper and lower housings and a stopper limiting the movement of said moving member.

* * * * *

UNITED STATES PATENT AND TRADEMARK OFFICE

CERTIFICATE OF CORRECTION

PATENT NO. : 5,373,936

DATED : December 20, 1994

INVENTOR(S) : TSUTOMU KAWAI, ET AL.

It is certified that error appears in the above-identified patent and that said Letters Patent is hereby corrected as shown below:

ON TITLE PAGE

In [56] References Cited, under FOREIGN PATENT DOCUMENTS:

| | | | |
|---|---|---|---|
| "03101944 | 4/1991 | Japan | |
| 03101945 | 4/1991 | Japan | |
| 03176156 | 7/1991 | Japan | |
| 03234659 | 10/1991 | Japan" | should read |
| --3-101944 | 4/1991 | Japan | |
| 3-101945 | 4/1991 | Japan | |
| 3-176156 | 7/1991 | Japan | |
| 3-234659 | 10/1991 | Japan--. | |

COLUMN 1

Line 19, "type" should read --type device--.
Line 45, "clogged" should read --clogged,--.
Line 61, "may" should read --to--.

COLUMN 2

Line 57, "cross sectional" should read --cross-sectional--.
Line 62, "cross sectional" should read --cross-sectional--.
Line 66, "cross sectional" should read --cross-sectional--.

COLUMN 4

Line 17, "of the" should be deleted.
Line 48, "being close" should read --being in close--.

UNITED STATES PATENT AND TRADEMARK OFFICE

CERTIFICATE OF CORRECTION

PATENT NO. : 5,373,936

DATED : December 20, 1994

INVENTOR(S) : TSUTOMU KAWAI, ET AL.

It is certified that error appears in the above-identified patent and that said Letters Patent is hereby corrected as shown below:

COLUMN 5

Line 34, "10" should be deleted.
Line 40, "chamber allows" should read --chamber A flows--.

COLUMN 6

Line 16, "released" should read --release--.
Line 52, "suffice if only" should read --work unless--.

COLUMN 7

Line 8, "matching the number of cartridges" should read --is--.
Line 9, "required when" should read --required. (Usually, a black ink cartridge is most often used, and when--.

COLUMN 8

Line 26, "a" should read --a wet--.
Line 29, "of-a" should read --of a--.
Line 33, "10" should be deleted.
Line 43, "inkier" should read --ink--.

UNITED STATES PATENT AND TRADEMARK OFFICE

CERTIFICATE OF CORRECTION

PATENT NO. : 5,373,936

DATED : December 20, 1994

INVENTOR(S) : TSUTOMU KAWAI, ET AL.

It is certified that error appears in the above-identified patent and that said Letters Patent is hereby corrected as shown below:

COLUMN 8 (con't)

Line 47, "mount" should read --point--.

Signed and Sealed this

Thirteenth Day of June, 1995

Bruce Lehman

*Attest:*

BRUCE LEHMAN

*Attesting Officer*

*Commissioner of Patents and Trademarks*